US010345049B2

(12) United States Patent
Sun et al.

(10) Patent No.: US 10,345,049 B2
(45) Date of Patent: Jul. 9, 2019

(54) COMMUNICATION-TYPE THERMAL CONDUCTION DEVICE

(71) Applicant: COOLER MASTER CO., LTD., New Taipei (TW)

(72) Inventors: Chien-Hung Sun, New Taipei (TW); Leilei Liu, New Taipei (TW); Xiao-Min Zhang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 95 days.

(21) Appl. No.: 15/485,201

(22) Filed: Apr. 11, 2017

(65) Prior Publication Data

US 2018/0292145 A1 Oct. 11, 2018

(51) Int. Cl.

| | |
|---|---|
| ***F28D 15/04*** | (2006.01) |
| ***F28D 15/02*** | (2006.01) |
| ***F28F 9/007*** | (2006.01) |

(52) U.S. Cl.

CPC ..... *F28D 15/046* (2013.01); *F28D 15/0233* (2013.01); *F28D 15/0258* (2013.01); *F28D 15/0266* (2013.01); *F28D 15/0275* (2013.01); *F28F 9/0075* (2013.01); *F28F 2240/00* (2013.01); *F28F 2255/18* (2013.01)

(58) Field of Classification Search

CPC ..... F28D 15/046; F28D 15/0258; F28D 15/0266; F28D 15/0233; F28D 15/0275

See application file for complete search history.

(56) References Cited

U.S. PATENT DOCUMENTS

| | | | | |
|---|---|---|---|---|
| 6,796,373 | B1 * | 9/2004 | Li | F28D 15/04 165/104.21 |
| 7,443,677 | B1 * | 10/2008 | Zhou | F28D 15/0275 165/104.21 |
| 10,048,015 | B1 * | 8/2018 | Lin | F28D 15/04 |
| 2005/0092465 | A1 * | 5/2005 | Lin | F28D 15/0275 165/104.21 |
| 2005/0178532 | A1 * | 8/2005 | Meng-Cheng | F28D 15/0233 165/104.33 |
| 2006/0162905 | A1 * | 7/2006 | Hsu | F28D 15/0233 165/104.26 |

(Continued)

*Primary Examiner* — Cassey D Bauer
*Assistant Examiner* — Jenna M Hopkins
(74) *Attorney, Agent, or Firm* — Locke Lord LLP; Tim Tingkang Xia, Esq.

(57) ABSTRACT

A communication-type thermal conduction device includes a vapor chamber, at least one heat pipe, and at least one third capillary structure. The vapor chamber has a bottom board. A first capillary structure is disposed on an inner surface of the bottom board. A second capillary structure is disposed in the heat pipe. One end portion of the heat pipe is connected to the bottom board, and the end portion has an open portion in communication with the heat pipe and the vapor chamber. The second capillary structure has a connected portion exposed by means of the open portion. The third capillary structure is connected to the first capillary structure and the connected portion, so that the first and second capillary structures are in communication with each other. Accordingly, holistic thermal conduction can be achieved, and the vapor chamber incorporating the heat pipe can provide the desired heat dissipation effect.

19 Claims, 9 Drawing Sheets

(56) References Cited

U.S. PATENT DOCUMENTS

| | | | | |
|---|---|---|---|---|
| 2007/0240855 | A1* | 10/2007 | Hou | F28D 15/046 165/104.26 |
| 2009/0025910 | A1* | 1/2009 | Hoffman | F28D 15/046 165/104.26 |
| 2010/0326629 | A1* | 12/2010 | Meyer, IV | F28D 15/0233 165/104.26 |
| 2011/0220328 | A1* | 9/2011 | Huang | F28D 15/0241 165/104.26 |
| 2014/0182819 | A1* | 7/2014 | Yang | F28D 15/04 165/104.26 |
| 2015/0083372 | A1* | 3/2015 | Yang | F28D 15/02 165/104.26 |
| 2015/0101784 | A1* | 4/2015 | Pai | F28D 15/0233 165/104.26 |
| 2016/0003555 | A1* | 1/2016 | Sun | F28D 15/046 165/104.26 |
| 2016/0348985 | A1* | 12/2016 | Sun | F28D 15/0275 |
| 2017/0122672 | A1* | 5/2017 | Lin | B23K 1/19 |
| 2017/0153066 | A1* | 6/2017 | Lin | F28D 15/0266 |
| 2017/0227298 | A1* | 8/2017 | Sun | F28D 15/04 |
| 2017/0292793 | A1* | 10/2017 | Sun | F28D 15/0233 |
| 2017/0312871 | A1* | 11/2017 | Lin | B23P 15/26 |
| 2017/0343297 | A1* | 11/2017 | Lan | F28D 15/0233 |
| 2017/0350657 | A1* | 12/2017 | Yeh | F28D 15/0266 |
| 2017/0356694 | A1* | 12/2017 | Tan | F28D 15/0233 |
| 2018/0023416 | A1* | 1/2018 | Riaz | F01D 17/145 415/1 |
| 2018/0066896 | A1* | 3/2018 | Lin | F28D 15/04 |
| 2018/0106552 | A1* | 4/2018 | Lin | H01L 23/427 |
| 2018/0350718 | A1* | 12/2018 | Lin | H01L 21/4882 |

* cited by examiner

COMMUNICATION-TYPE THERMAL CONDUCTION DEVICE

BACKGROUND OF THE INVENTION

1. Field of the Invention

The invention relates to a thermal conduction device and, more particularly, to a communication-type thermal conduction device allowing capillary structures of a vapor chamber and a heat pipe to be connected and in communication with each other.

2. Description of the Prior Art

Regarding thermal conduction, to dissipate heat from a heat generating component, a conventional thermal conduction device uses a thermal plate and a heat pipe to conduct heat and uses a radiator (e.g. fins and fan) to dissipate heat.

In general, the thermal plate contacts the heat generating component and the heat pipe is connected between the thermal plate and the radiator, so that heat generated by the heat generating component is conducted to the thermal plate first and then the thermal plate conducts heat to the radiator through the heat pipe, so as to dissipate heat.

However, the thermal plate and the heat pipe in the conventional thermal conduction device work individually and a capillary structure of the thermal plate is not connected to a capillary structure of the heat pipe. Accordingly, the thermal plate and the heat pipe conduct heat individually rather than as a whole. In other words, the heat dissipation effect cannot be performed completely.

Therefore, how to design a thermal conduction device to improve the aforesaid problems has become a significant issue nowadays.

SUMMARY OF THE INVENTION

An objective of the invention is to provide a communication-type thermal conduction device allowing capillary structures of a heat pipe and a vapor chamber to be in communication with each other, so as to achieve holistic thermal conduction. Accordingly, the vapor chamber incorporating the heat pipe can fully provide the desired heat dissipation effect.

To achieve the aforesaid objective, the invention provides a communication-type thermal conduction device comprising a vapor chamber, a heat pipe and a third capillary structure. The vapor chamber has a bottom board and a first capillary structure is disposed on an inner surface of the bottom board. A second capillary structure is disposed in the heat pipe. One end portion of the heat pipe is connected to the bottom board, wherein the end portion has an open portion in communication with the heat pipe and the vapor chamber. The second capillary structure has a connected portion exposed by means of the open portion. The third capillary structure is connected to the first capillary structure and the connected portion, so that the first and second capillary structures are in communication with each other.

Compared to the prior art, the invention has the following advantage. The invention allows the second capillary structure of the heat pipe to be connected and in communication with the first capillary structure of the vapor chamber, so as to achieve holistic thermal conduction. Accordingly, the vapor chamber incorporating the heat pipe can fully provide the desired heat dissipation effect.

These and other objectives of the present invention will no doubt become obvious to those of ordinary skill in the art after reading the following detailed description of the preferred embodiment that is illustrated in the various figures and drawings.

DETAILED DESCRIPTION

The detailed description and features of the invention are depicted along with drawings in the following. However, the drawings are used for illustration purpose only, so the invention is not limited to the drawings.

Figure 8:
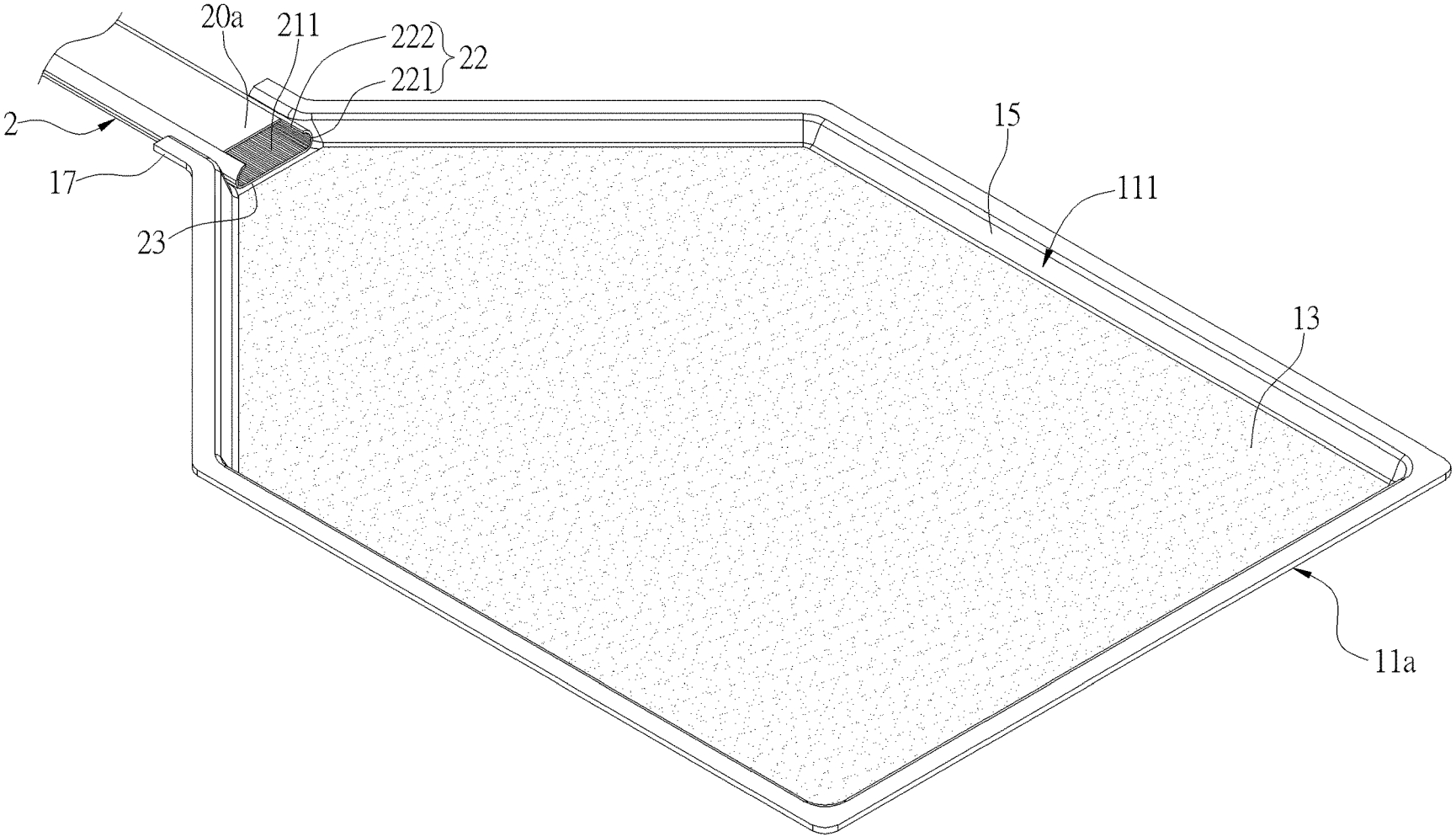
FIG. 8 is an assembly view illustrating a second embodiment of the invention without the cover board.
Figure 9:
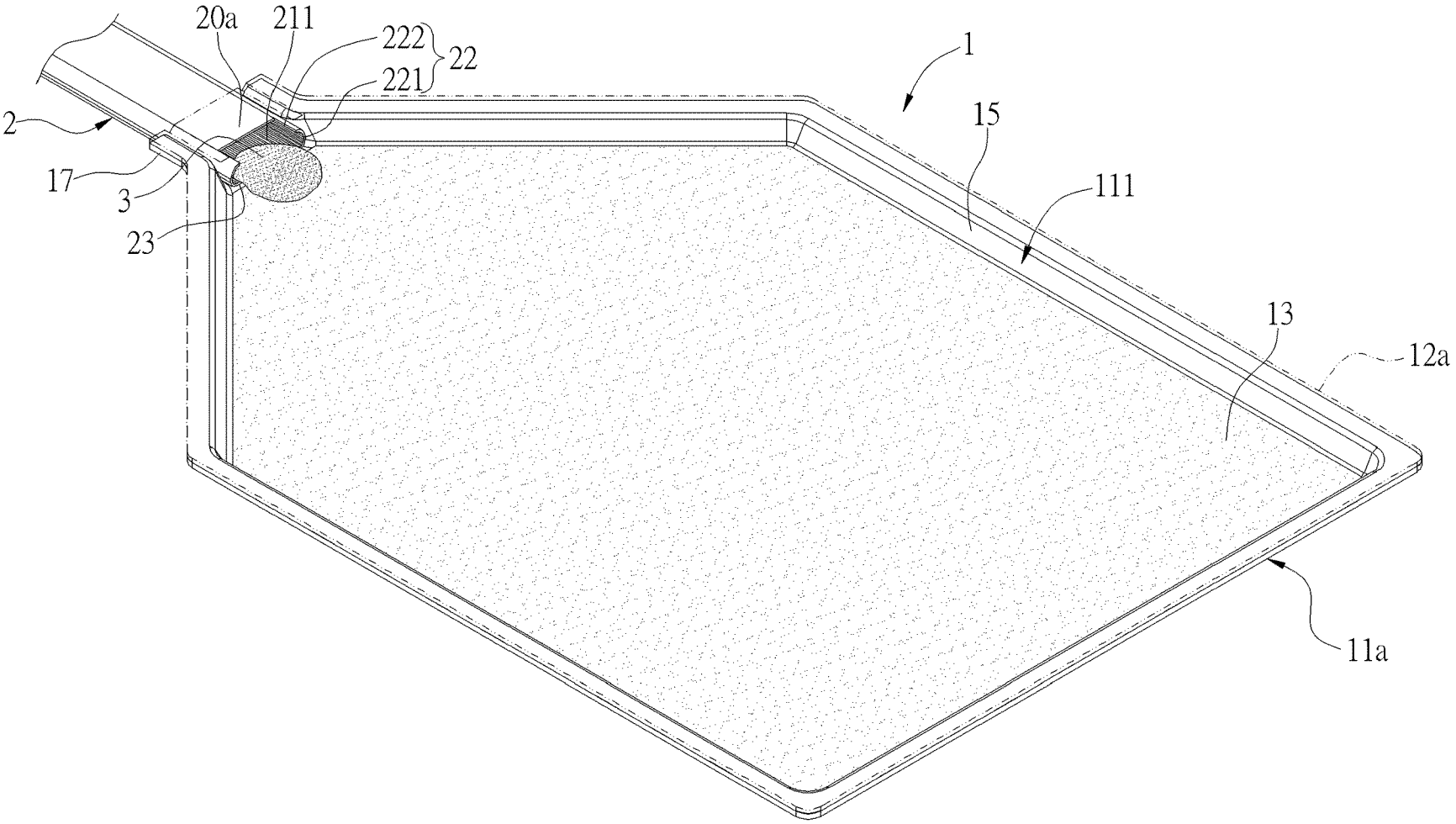
FIG. 9 is a perspective view illustrating that the second embodiment of the invention is assembled and the third capillary structure is connected.
Figure 10:
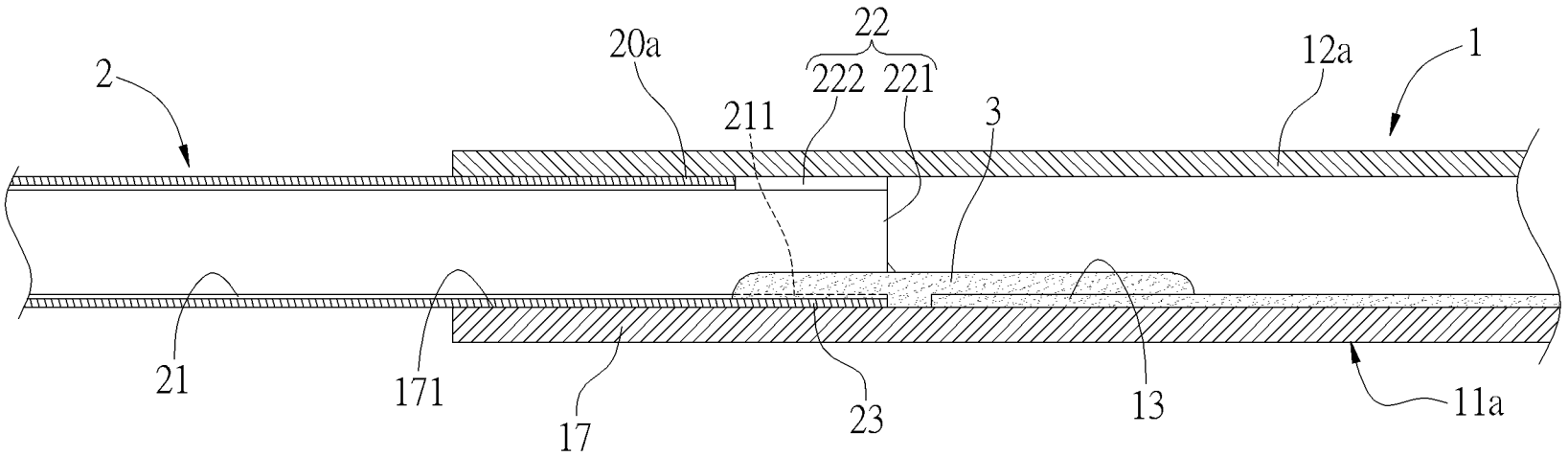
FIG. 10 is a sectional view illustrating parts of the second embodiment of the invention shown in FIG. 9.

The invention provides a communication-type thermal conduction device. FIGS. 1 to 7 illustrate a first embodiment of the invention and FIGS. 8 to 10 illustrate a second embodiment of the invention.

As shown in FIGS. 1 to 7, the communication-type thermal conduction device of the first embodiment of the invention comprises a vapor chamber 1 and at least one heat pipe 2. Needless to say, the communication-type thermal conduction device further comprises a working fluid (not shown) flowing between the vapor chamber 1 and the heat pipe 2.

Figure 6:
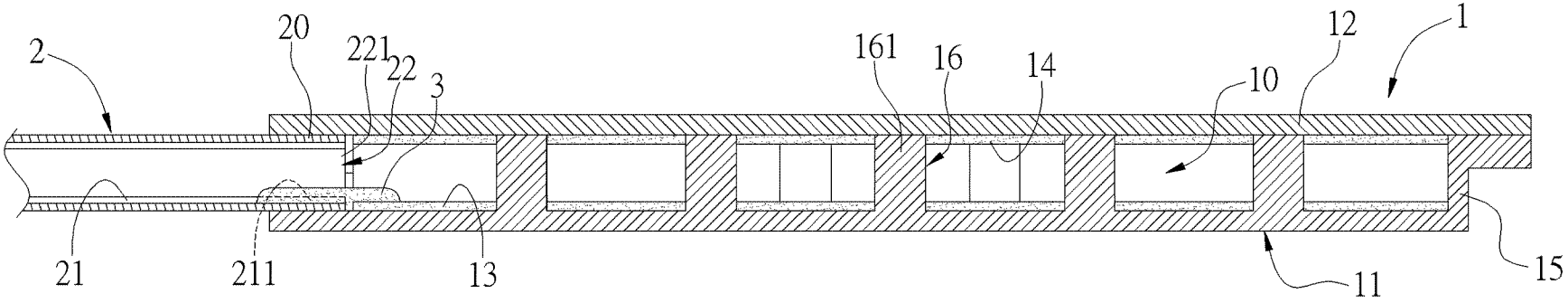
FIG. 6 is a sectional view illustrating the first embodiment of the invention after being assembled, wherein the heat pipe is sectioned in an axial direction.

The vapor chamber 1 has a bottom board 11 and a cover board 12, wherein the bottom board 11 and the cover board 12 are opposite to each other. After assembling the bottom board 11 and the cover board 12, a chamber 10 (as shown in FIG. 6) is formed between the bottom board 11 and the cover board 12. The vapor chamber 1 may be a structure formed integrally or an assembled structure. In this embodiment, an assembled structure is used for illustrating the invention. That is to say, the cover board 12 can be assembled with the bottom board 11, so as to form the vapor chamber 1 with the chamber 10 therein.

A first capillary structure 13 is disposed on an inner surface of the bottom board 11 and a fourth capillary structure 14 (as shown in FIG. 6) is disposed on an inner surface of the cover board 12, wherein the first and fourth capillary structures 13, 14 are opposite to each other. The first and fourth capillary structures 13, 14 may be powder sintered structures, ceramic sintered structures, metal mesh structures, fiber bundle structures, metal grooves and so on. The invention does not limit the first and fourth capillary structures 13, 14 to any specific structures. The fiber bundle structure is a structure consisting of a plurality of fiber bundles adjacent to each other. However, in some embodiments, the inner surface of the cover board 12 does not has the fourth capillary structure 14 disposed thereon. In other words, only the inner surface of the bottom board 11 has the first capillary structure 13 disposed thereon.

The heat pipe 2 is a hollow tube and a second capillary structure 21 is disposed in the heat pipe 2. One end portion 20 of the heat pipe 2 is connected to the bottom board 11. The end portion 20 has an open portion 22 in communication with the hollow inside of the heat pipe 2 and the chamber 10 of the vapor chamber 1 and for vapor to flow. The second capillary structure 21 has a connected portion 211 exposed by means of the open portion 22.

Figure 3:
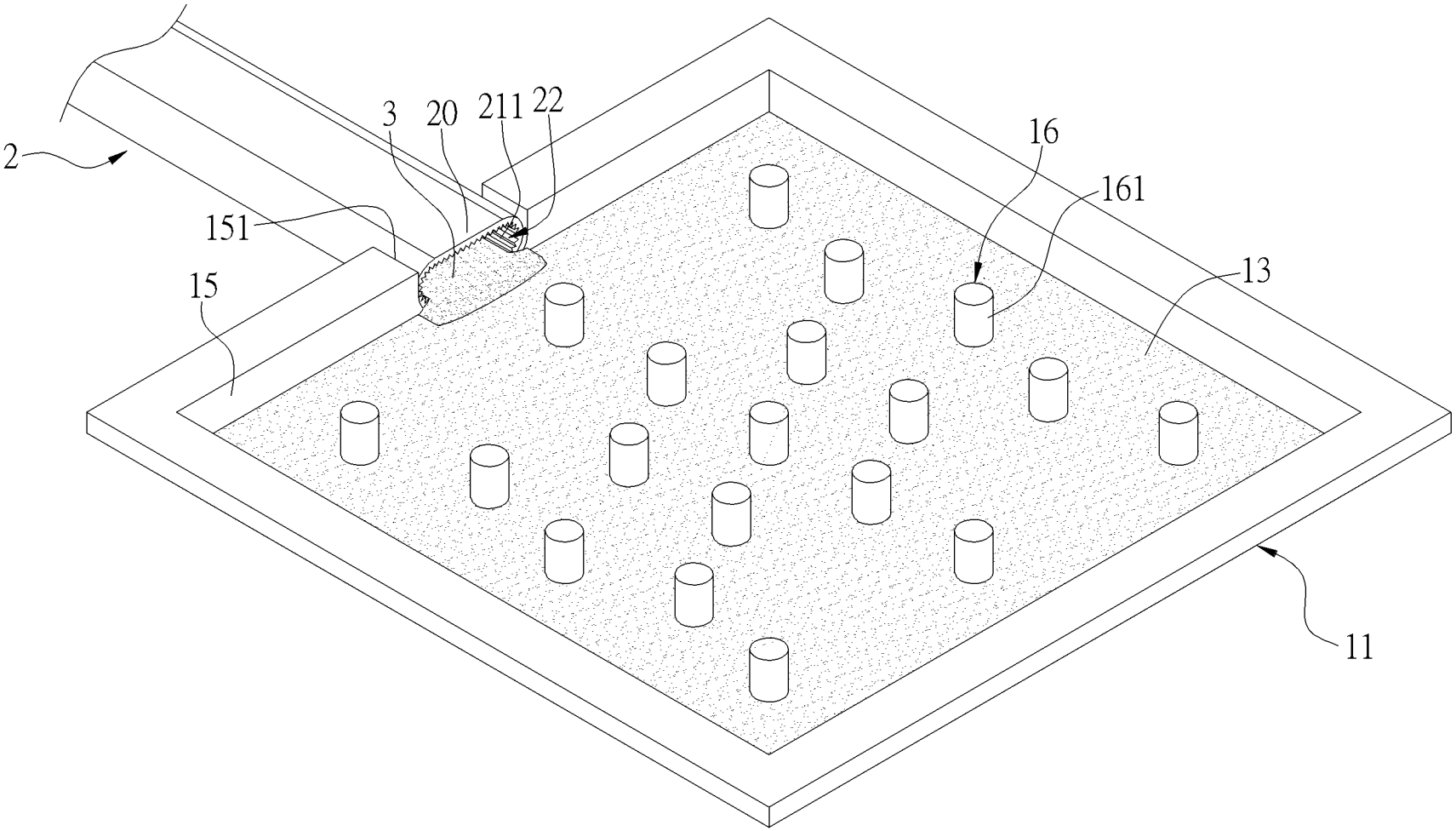
FIG. 3 is a perspective view illustrating that the third capillary structure is connected to FIG. 2.

The third capillary structure 3 (as shown in FIG. 3) is connected between the first capillary structure 13 and the connected portion 211 of the second capillary structure 21, so that the first and second capillary structures 13, 21 are in communication with each other. Therefore, the first capillary structure 13 disposed in the vapor chamber 1 and the second capillary structure 21 disposed in the heat pipe 2 can be connected and in communication with each other, so as to achieve holistic thermal conduction. Accordingly, the vapor chamber 1 incorporating the heat pipe 2 can fully provide the desired heat dissipation effect.

Figure 2:
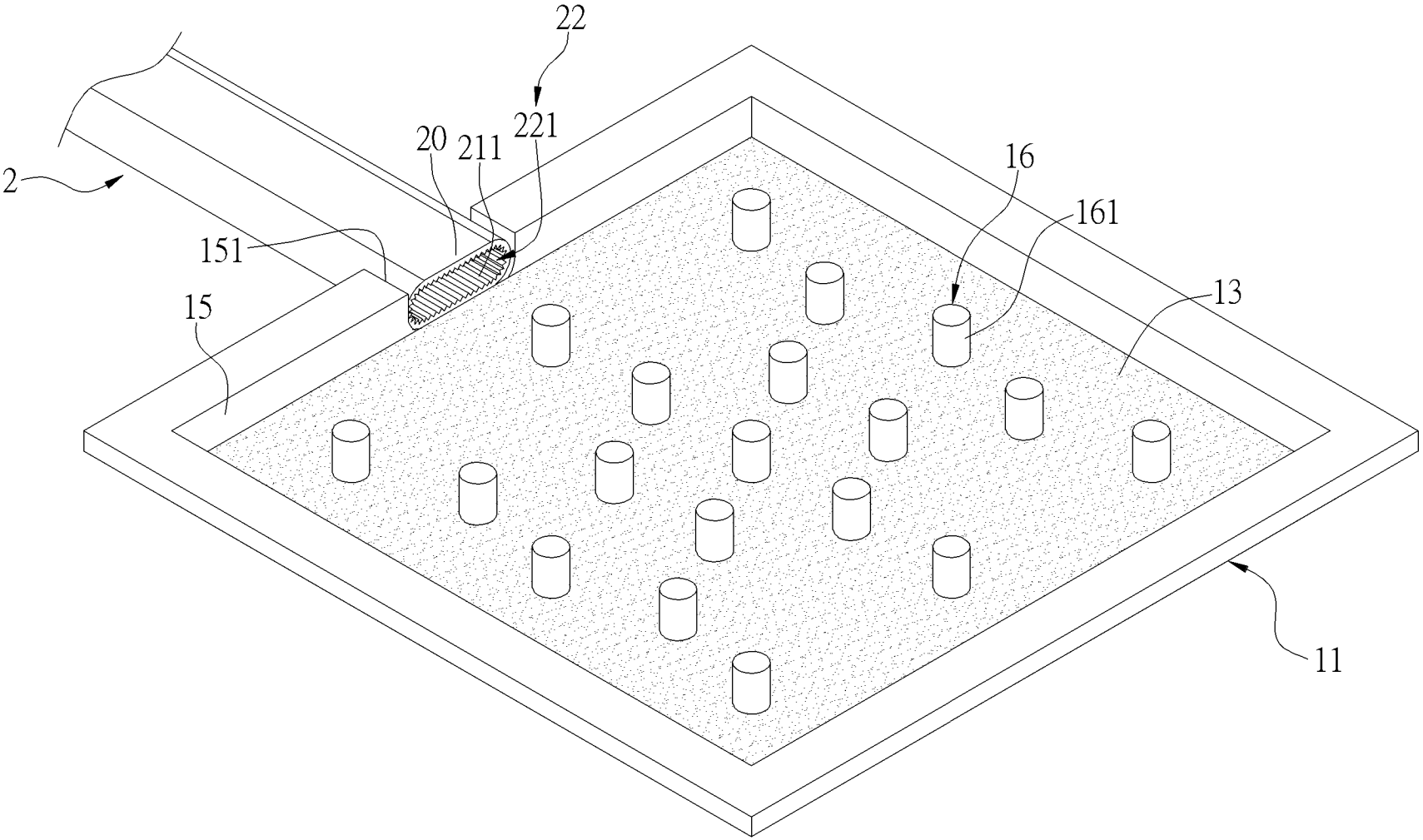
FIG. 2 is an assembly view illustrating the first embodiment of the invention without the cover board.

In this embodiment, a surrounding board 15 surrounds a periphery of the bottom board 11, and the end portion 20 of the heat pipe 2 may be inserted into and in communication with the surrounding board 15 (not shown), so that the heat pipe 2 is arranged with the vapor chamber 1 side by side. Alternatively, the surrounding board 15 may have a hole 151 formed thereon, and the end portion 20 of the heat pipe 2 may be connected to an inner bottom surface of the bottom board 11 through the hole 151 (as shown in FIG. 2), so that the heat pipe 2 is arranged with the vapor chamber 1 side by side. In detail, for illustration purpose, the so-called "arranged side by side" means that the heat pipe 2 is substantially parallel to the vapor chamber 1. Accordingly, the connected portion 211 of the second capillary structure 21 is also arranged with the first capillary structure 13 side by side, so as to enhance the connection. After the third capillary structure 3 is connected to the first capillary structure 13 and the connected portion 211 of the second capillary structure 21, the first, second and third capillary structures 13, 21, 3 are arranged side by side, so as to be applied to the thin vapor chamber 1 and the flat heat pipe 2.

Furthermore, the open portion 22 of the heat pipe 2 may comprise an opening 221 formed on an end of the heat pipe 2 (i.e. one of both ends of the heat pipe 2) and the connected portion 211 is exposed by means of the opening 221. In detail, for illustration purpose, the so-called "exposed" means that the connected portion 211 does not protrude out of the opening 221. The opening 221 of the heat pipe 2 is in communication with the chamber 10 of the vapor chamber 1, wherein vapor can flow through the opening 221 and the opening 221 is contributive to connect the third capillary structure 3.

Moreover, the third capillary structure 3 may be formed by a powder sintered manner or a ceramic sintered manner and connected between the first capillary structure 13 and the connected portion 211 (as shown in FIGS. 3 to 6). Alternatively, the third capillary structure 3 may be a metal mesh structure or a fiber bundle structure (not shown). In other words, the invention does not limit the third capillary structure 3 to any specific structures.

Figure 4:
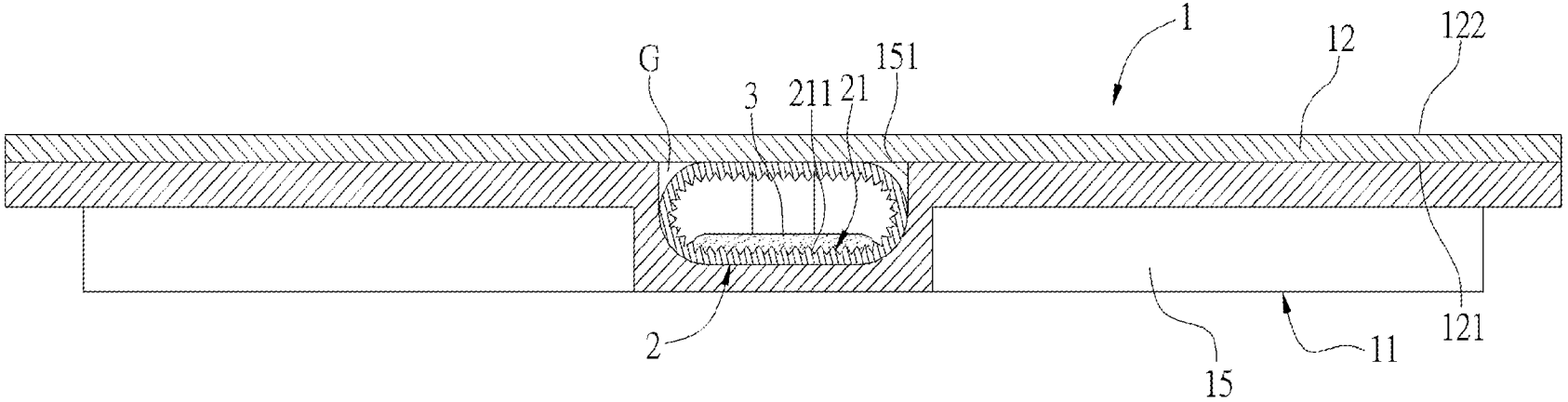
FIG. 4 is a sectional view illustrating the first embodiment of the invention after being assembled, wherein the heat pipe is sectioned in a radial direction, so as to show a state of the cover board before being sunk.
Figure 5:
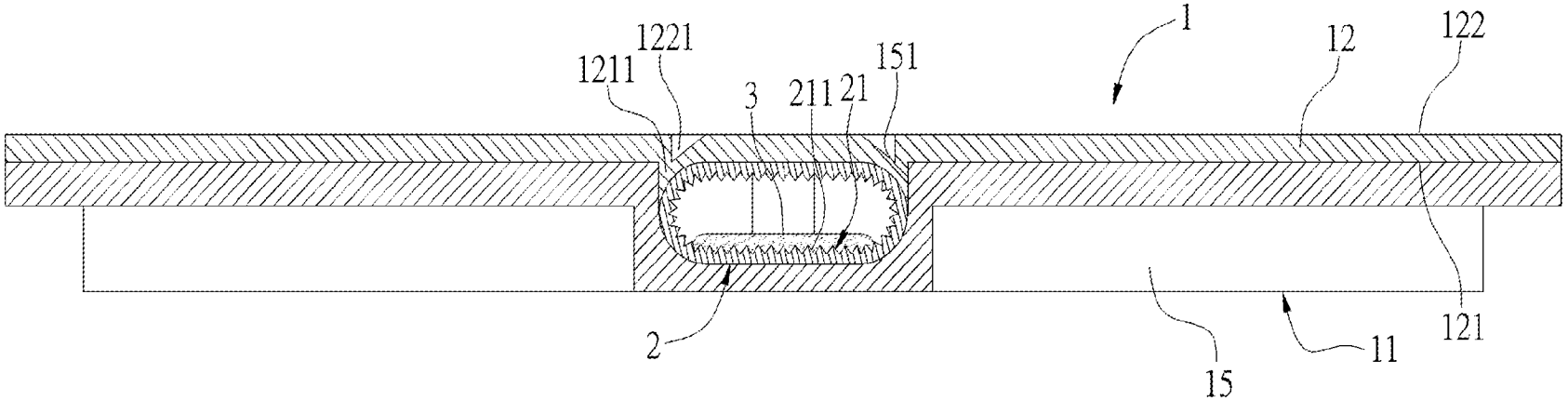
FIG. 5 is a sectional view illustrating the first embodiment of the invention after being assembled, wherein the heat pipe is sectioned in a radial direction, so as to show a state of the cover board after being sunk.
Figure 7:
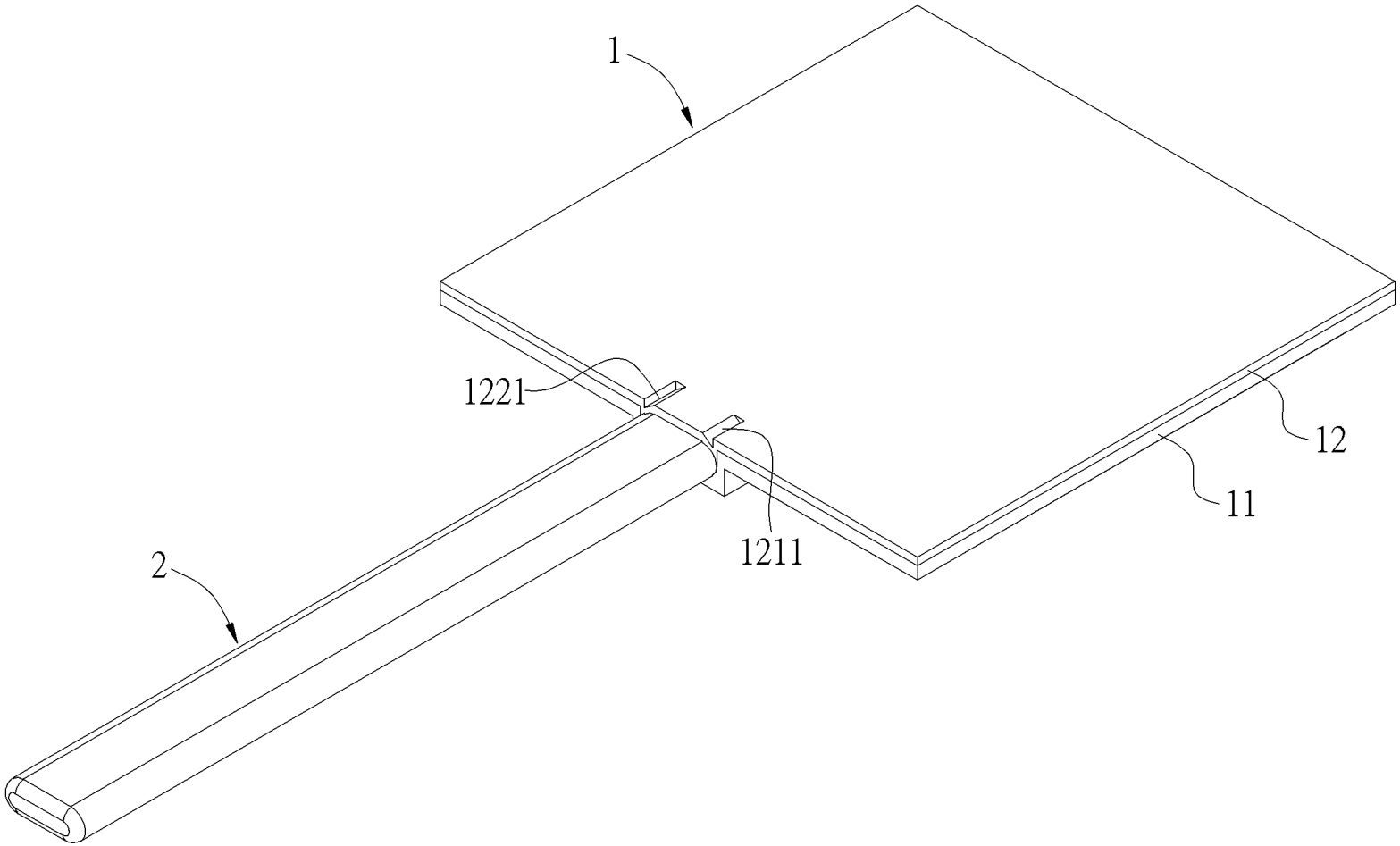
FIG. 7 is an assembly view illustrating the first embodiment of the invention.

Still further, as shown in FIGS. 4, 5 and 7, the cover board 12 is sealed on an open edge of the surrounding board 15, so as to seal the vapor chamber 1 and form the chamber 10. A gap G is formed between a side of the end portion 20 and the surrounding board 15 corresponding to the hole 151. A filler 1211 is formed on the cover board 12 and corresponds to the gap G and the filler 1211 is filled in the gap G correspondingly. In this embodiment, the filler 1211 is formed by sinking the cover board 12 correspondingly. In detail, the cover board 12 has an inner surface 121 and an outer surface 122 corresponding to each other, and a position of the outer surface 122 of the cover board 12 is sunk to form a recess portion 1221, so that the filler 1211 extends from the inner surface 121 of the cover board 12 integrally. The filler 1211 is filled in the gap G correspondingly, so that the heat pipe 2 can be more suitable for the hole 151 of the vapor chamber 1 and the heat pipe 2 can be welded to the vapor chamber more easily. Needless to say, the filler 1211 may also be an individual object filled in the gap G. In other words, the invention does not limit the filler 1211 to the structure corresponding to the recess portion 1221 and the filler 1211 may be an individual object.

FIGS. 8 to 10 illustrate a communication-type thermal conduction device of the second embodiment of the invention. The second embodiment is substantially similar to the aforesaid first embodiment. The difference is that the end portion 20*a* of the heat pipe 2 of the second embodiment is different from the end portion 20 of the first embodiment and the vapor chamber 1 of the second embodiment is also different from the vapor chamber 1 of the first embodiment. The details are depicted in the following.

In the second embodiment, the end portion 20*a* further comprises a breach 222. The breach 222 is formed on a periphery of the end portion 20*a* (i.e. the body of the heat pipe 2), and the breach 222 is connected to and in communication with the aforesaid opening 221, so that the third capillary structure 3 can be connected more conveniently and easily. Accordingly, the end portion 20*a* may form a mandible portion 23 by means of the open portion 22, the connected portion 211 is located at an inner surface of the mandible portion 23, and the connected portion 211 is exposed through the open portion 22 including the opening 221 and the breach 222.

A surrounding board 15 surrounds a periphery of the bottom board 11*a* to form a recess space 111 and a communication neck 17 extends from the bottom board 11*a* and the surrounding board 15 outwardly, so that the communication neck 17 is in communication with the recess space 111 and an outside of the vapor chamber 1. The heat pipe 2 and the mandible portion 23 of the end portion 20*a* thereof are connected to an inner bottom surface 171 of the communication neck 17, so as to enhance the connection of the heat pipe 2.

Figure 1:
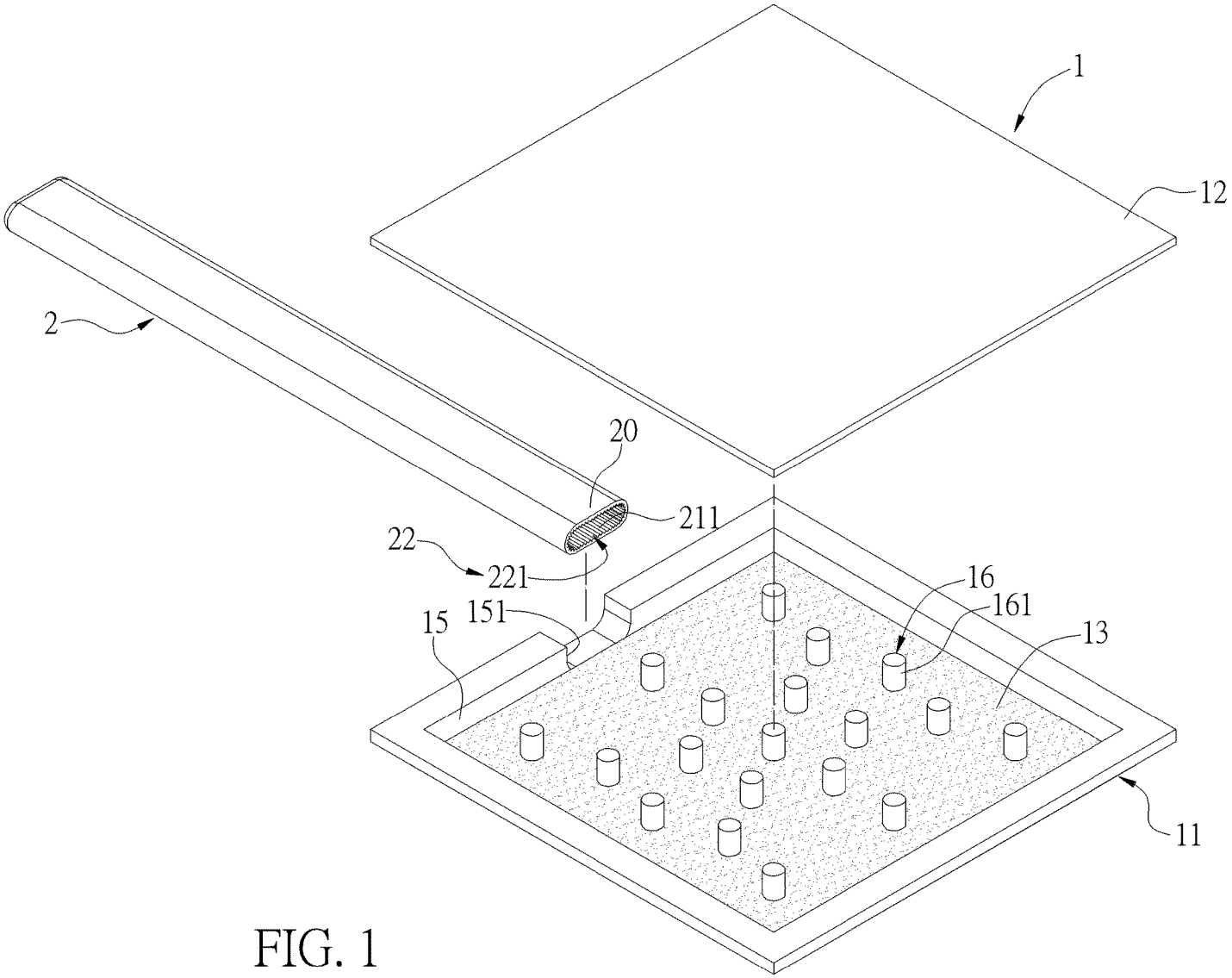
FIG. 1 is an exploded view illustrating a first embodiment of the invention.

Furthermore, as shown in FIGS. 1 to 3, a first support structure 16 is disposed in the vapor chamber 1. In the first and second embodiments, a plurality of support pillars 161 is used for illustration purpose, wherein the support pillars 161 support the bottom board 11 (11*a*) and the cover board 12 (12*a*), so as to prevent the vapor chamber 1 from deforming when the vapor chamber 1 is vacuumized.

Moreover, a second support structure (not shown) may be disposed in the heat pipe 2, so that the second support structure can support the flat heat pipe 2 therein, so as to prevent the heat pipe 2 from breaking when the heat pipe 2 is flatted. Still further, the third capillary structure 3 may be formed with the first capillary structure 13 or the second capillary structure 21 integrally. For example, the third capillary structure 3 and the first capillary structure 13 (or the third capillary structure 3 and the second capillary structure 21) both may be formed by a powder sintered manner or a ceramic sintered manner integrally.

As mentioned in the above, compared to the prior art, the invention has the following advantage. The invention allows the second capillary structure 21 of the heat pipe 2 to be connected and in communication with the first capillary structure 13 of the vapor chamber 1, so as to achieve holistic thermal conduction. Accordingly, the vapor chamber 1 incorporating the heat pipe 2 can fully provide the desired heat dissipation effect.

Furthermore, the invention further has other advantages in the following. By means of arranging the first, second and third capillary structures 13, 21, 3 side by side, the invention can be applied to the thin vapor chamber 1 and the flat heat pipe 2. The open portion is contributive to connect the third capillary structure 3. Especially, when the open portion 22 comprises the opening 221 and the breach 222, the mandible portion 23 can be formed, so that the third capillary structure 3 can be connected more conveniently and easily. By means of sinking the cover board 12, 12*a* to form the recess portion 1221, the filler 1211 extending from the inner surface of the cover board can be filled in the gap G between the heat pipe 2 and the vapor chamber 1, so that the heat pipe 2 is more suitable for the hole 151 of the vapor chamber 1. Accordingly, the heat pipe 2 can be welded to the vapor chamber 1 more easily. Since the communication neck 17 extends from the vapor chamber 1 integrally, the heat pipe 2 can be connected to the vapor chamber 1 well. By means of the first support structure 16 and the second support structure, the invention can prevent the vapor chamber 1 from deforming when the vapor chamber 1 is vacuumized and prevent the heat pipe 2 from breaking when the heat pipe 2 is flatted.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication-type thermal conduction device comprising:

a vapor chamber having a bottom board, a first capillary structure being disposed on an inner surface of the bottom board;

a heat pipe, a second capillary structure being disposed in the heat pipe, one end portion of the heat pipe being connected to the bottom board, the end portion having an open portion in communication with the heat pipe and the vapor chamber, the second capillary structure having a connected portion exposed by means of the open portion; and a third capillary structure connected to the first capillary structure and the connected portion, so that the first and second capillary structures are in communication with each other;

wherein the third capillary structure is formed with the first or second capillary structure integrally, and only the inner surface of the bottom board in the vapor chamber has the first capillary structure disposed thereon.

2. The communication-type thermal conduction device of claim 1, wherein the third capillary structure and the first capillary structure are formed by a powder sintered manner or a ceramic sintered manner, or the third capillary structure and the second capillary structure are formed by a powder sintered manner or a ceramic sintered manner.

3. The communication-type thermal conduction device of claim 1, wherein the third capillary structure is a metal mesh structure or a fiber bundle structure.

4. The communication-type thermal conduction device of claim 1, wherein the connected portion of the second capillary structure and the first capillary structure are arranged side by side.

5. The communication-type thermal conduction device of claim 1, wherein a surrounding board surrounds a periphery of the bottom board, and the end portion of the heat pipe is inserted into the surrounding board, so that the heat pipe is arranged with the vapor chamber side by side.

6. The communication-type thermal conduction device of claim 5, wherein the first, second and third capillary structures are arranged side by side.

7. The communication-type thermal conduction device of claim 1, wherein a surrounding board surrounds a periphery of the bottom board, the surrounding board has a hole, and the end portion of the heat pipe is connected to an inner bottom surface of the bottom board through the hole, so that the heat pipe is arranged with the vapor chamber side by side.

8. The communication-type thermal conduction device of claim 7, wherein the first, second and third capillary structures are arranged side by side.

9. The communication-type thermal conduction device of claim 1, wherein the vapor chamber further has a cover board, a surrounding board surrounds a periphery of the bottom board, the cover board is sealed on an open edge of the surrounding board, the end portion is inserted into the surrounding board, a gap is formed between a side of the end portion and the surrounding board, a filler is formed on the cover board and corresponds to the gap, and the filler is filled in the gap.

10. The communication-type thermal conduction device of claim 9, wherein the cover board has an outer surface and an inner surface corresponding to each other, the filler extends from the inner surface integrally, and a recess portion is formed on the outer surface and corresponds to the filler.

11. The communication-type thermal conduction device of claim 1, wherein the open portion comprises an opening formed on an end of the heat pipe.

12. The communication-type thermal conduction device of claim 11, wherein the open portion further comprises a breach formed on the end portion, and the breach is connected to and in communication with the opening.

13. The communication-type thermal conduction device of claim 12, wherein the end portion forms a mandible portion by means of the open portion, and the connected portion is located at an inner surface of the mandible portion and exposed through the open portion.

14. The communication-type thermal conduction device of claim 13, wherein a surrounding board surrounds a periphery of the bottom board to form a recess space, a communication neck extends from the bottom board and the surrounding board outwardly, the communication neck is in communication with the recess space and an outside of the vapor chamber, the communication neck has an inner bottom surface, and the mandible portion is connected to the inner bottom surface of the communication neck.

15. The communication-type thermal conduction device of claim 1, wherein a first support structure is disposed in the vapor chamber.

16. The communication-type thermal conduction device of claim 1, wherein a second support structure is disposed in the heat pipe.

17. The communication-type thermal conduction device of claim 16, wherein the heat pipe is a flat heat pipe and the second support structure supports the flat heat pipe therein.

18. A communication-type thermal conduction device comprising:

a vapor chamber having a bottom board, a first capillary structure being disposed on an inner surface of the bottom board;

a heat pipe, a second capillary structure being disposed in the heat pipe, one end portion of the heat pipe being connected to the bottom board, the end portion having an open portion in communication with the heat pipe and the vapor chamber, the second capillary structure having a connected portion exposed by means of the open portion, the open portion comprising an opening and a breach, the opening being formed on an end of the heat pipe, the breach being formed on the end portion, and the breach being connected to and in communication with the opening; and a third capillary structure connected to the first capillary structure and the connected portion, so that the first and second capillary structures are in communication with each other;

wherein only the inner surface of the bottom board in the vapor chamber has the first capillary structure disposed thereon.

19. A communication-type thermal conduction device comprising:

a vapor chamber having a bottom board, a first capillary structure being disposed on an inner surface of the bottom board;

a heat pipe, a second capillary structure being disposed in the heat pipe, one end portion of the heat pipe being connected to the bottom board, the end portion having an open portion in communication with the heat pipe and the vapor chamber, the second capillary structure having a connected portion exposed by means of the open portion; and a third capillary structure connected to the first capillary structure and the connected portion, so that the first and second capillary structures are in communication with each other;

wherein the vapor chamber further has a cover board, a surrounding board surrounds a periphery of the bottom board, the cover board is sealed on an open edge of the surrounding board, the end portion is inserted into the surrounding board, a gap is formed between a side of the end portion and the surrounding board, a filler is formed on the cover board and corresponds to the gap, and the filler is filled in the gap;

wherein the cover board has an outer surface and an inner surface opposite to each other, the inner surface faces the end portion, the filler extends from the inner surface integrally, and a recess portion is formed on the outer surface and corresponds to the filler.

* * * * *